United States Patent [19]

Yaghoubian

[11] Patent Number: 4,726,161

[45] Date of Patent: Feb. 23, 1988

[54] EARTHQUAKE ISOLATING SUPPORT

[76] Inventor: Nejde F. Yaghoubian, 14243 Greenleaf St., Sherman Oaks, Calif. 91423

[21] Appl. No.: 19,370

[22] Filed: Feb. 26, 1987

[51] Int. Cl.[4] ..... F16M 13/00; E04H 9/02

[52] U.S. Cl. ..... 52/167; 248/585; 248/638; 384/49

[58] Field of Search ..... 52/167; 248/580, 581, 248/585, 638; 384/49, 50

[56] References Cited

U.S. PATENT DOCUMENTS

| | | | |
|---|---|---|---|
| 1,005,963 | 10/1911 | Groat et al. . | |
| 2,014,643 | 9/1935 | Bakker . | |
| 2,972,162 | 2/1961 | Townsend | 384/49 X |
| 3,347,002 | 10/1967 | Penkuhn . | |
| 3,357,755 | 12/1967 | Danly | 384/49 |
| 3,730,463 | 5/1973 | Richard . | |
| 3,771,270 | 11/1973 | Byers . | |
| 3,906,689 | 9/1975 | Nakayama | 52/167 |
| 4,223,762 | 9/1980 | Gertal . | |
| 4,496,130 | 1/1985 | Toyama . | |
| 4,517,778 | 5/1985 | Nicolai | 52/167 |
| 4,644,714 | 2/1987 | Zayas | 52/167 |
| 4,662,133 | 5/1987 | Kondo | 52/167 |

FOREIGN PATENT DOCUMENTS

| | | | |
|---|---|---|---|
| 639666 | 5/1962 | Italy | 52/167 |
| 757661 | 8/1980 | U.S.S.R. | 52/167 |

*Primary Examiner*—Alfred C. Perham
*Assistant Examiner*—Richard E. Chilcot, Jr.
*Attorney, Agent, or Firm*—William W. Haefliger

[57] ABSTRACT

Apparatus to isolate an object or equipment from earthquake motion comprises:

(a) rollable bearing means supporting such structure for lateral motion generally parallel to a support;

(b) and other means including interengaged bowl and roller elements to yieldably resist such lateral movement of the structure.

Typically, the bowl element defines a bowl-shaped surface having an upright axis, and the roller element comprises a ball urged into engagement with that surface to exert lateral load on the object or equipment when the ball engages the bowl surface in laterally spaced relation to the bowl axis, one of the elements carried by the object or equipment to move laterally therewith and the other element carried by the support.

10 Claims, 6 Drawing Figures

10
17
27a
32
21
15
22
20
α
12
14
13
11
16
18
16a

10

40
41
42a
22
42a
41
40
42
42
11
16
42b
30
18
42b
16a
12

EARTHQUAKE ISOLATING SUPPORT

BACKGROUND OF THE INVENTION

This invention relates generally to isolation of structures and their contents from ground motion, and more particularly concerns apparatus for resisting displacement of structures and contents in response to earthquake movement, for minimizing transfer of earthquake related and generated motion to such structures, their contents and for restoring the structures to their original positions on and relative to floors or other supports.

During earthquakes, contents of a building tend to overturn, move around and get damaged by either crashing onto the floor or into other objects or walls. In addition, equipment with inner moving parts or modules could become inoperable from heavy shaking. This invention relates generally to a support system that modifies the adverse dynamic behavior of the objects and more particularly concerns an apparatus that absorbs earthquake related motion while guiding the object to return to its original location.

There is need for the apparatus as referred to where it is imperative that certain objects and/or equipment be protected from shaking, overturning and crashing into walls and other objects, as for example cabinets and shelvings containing valuable objects, computers, electrical panels and mechanical equipment. Firmly anchoring of objects and equipment into the ground or a building floor will directly transfer the dynamic energy generated by an earthquake into the object or the equipment destroying and shaking into pieces items incapable of absorbing or resisting dynamic forces.

Prior devices to absorb and resist induced dynamic energy were constructed for high frequency and very small displacements generated by machinery an other sources of dynamic excitations.

SUMMARY OF THE INVENTION

The major objective of the invention is to provide an apparatus to meet the above needs by isolating an object or equipment from shaking, overturning and being displaced from its original location. Basically, apparatus to isolate an, upright object or structure from earthquake motion comprises:

(a) rollable bearing means supporting the object or structures to allow lateral motion generally parallel to (and to lesser extent perpendicular to) a support or supports;

(b) and other means including interengaged bowl and spring loaded roller elements acting to yieldably resist such lateral movement of the structure, and preferably to return the structure or object to its original location.

As will appear, the bowl element typically defines a bowl-shaped surface having an upright axis, and the roller element comprises a ball urged into engagement with said surface to exert lateral load on the structure or object when the ball engages that surface in laterally spaced relation to the bowl axis, one of the elements carried by the structure to move laterally therewith, and the other element carried by the support; and the bowl surface may be carried to face upwardly or downwardly, as will appear.

It is further object to provide a generally vertically movable stem supporting the ball, and a vertical bearing for the stem, there being a spring urging the stem toward the bowl-shaped surface. Typically, the spring is a coil spring extending about the stem, and an adjuster is associated with the stem for adjusting spring tension. Also, a ball race engages the ball, and a linear bearing accomodates generally vertical movement of the ball race and stem.

Further objectives include the provision of yieldably compressed means carried by the structure and operatively connected with the stem via linkages to yieldably resist movement of the ball in a spring compressing direction; and the location of the structure weight transmitting ball bearings at multiple locations to transmit the bulk of structure weight to the support surface.

These and other objects and advantages of the invention, as well as the details of an illustrative embbdiment, will be more fully understood from the following specification and drawings, in which:

DRAWING DESCRIPTION

FIG. 1 is an elevation, partly in section,showing one form of the invention;

FIG. 1*a* is a schematic view showing displacement of elements of the FIG. 1 device, as during an earthquake;

DETAILED DESCRIPTION

Figure 1:
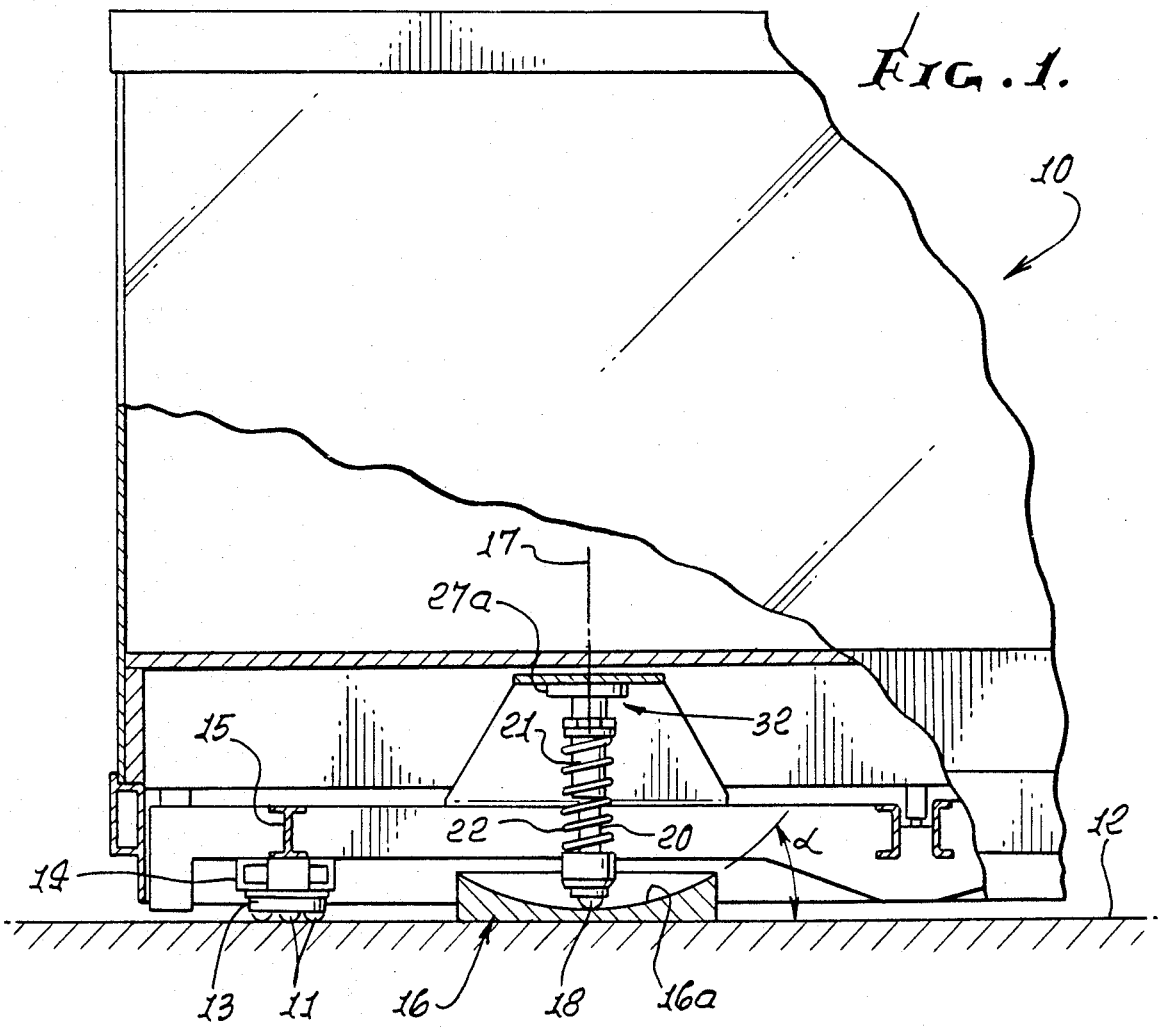
Figures 1A, 2:
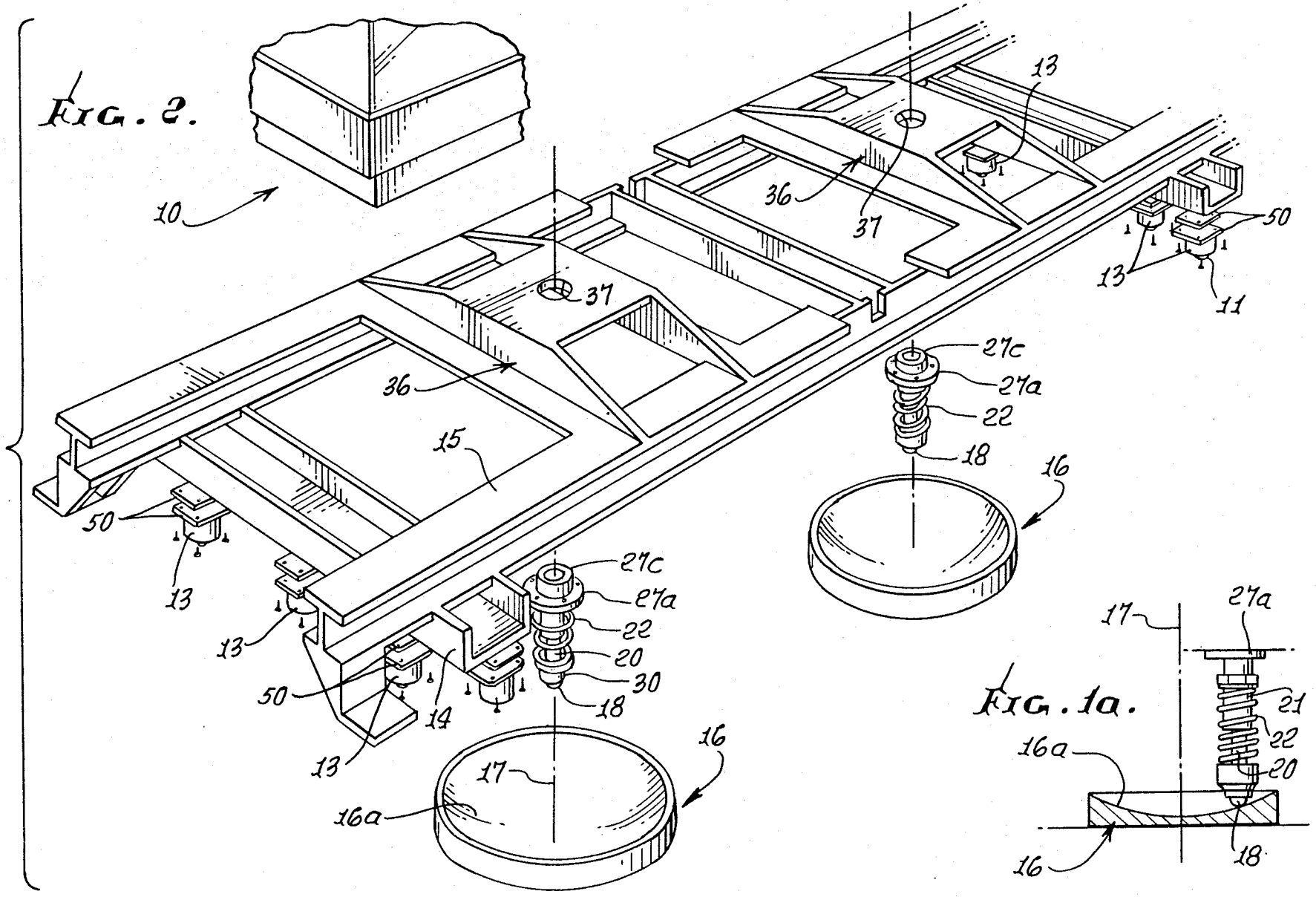
FIG. 2 is a perspective view showing elements of the FIG. 1 device, and associated structure, in exploded form.

In FIGS. 1 and 2, the upright structure, object or equipment to be isolated from earthquake motion is designated at 10 and may for example comprise a computer, or a cabinet in which valuable art objects are displayed or contained. The weight of the structure or object is supported on a floor 12 as by rollable bearing means, indicated for example by clustered ball bearings 11. Such bearings allow lateral motion of the floor relative to the structure 10, in any horizontal direction, as during an earthquake. The bearings 11 are suitably carried at 13 in cages supported by cross beams 14 and 15.

Other means is also provided to act upon the structure 10 to yieldably resist its lateral movement, and so as to exert lateral loading tending to restore the structure 10 to its initial position relative to the support floor 12, the restoring force increasing as a function of the distance of lateral movement of the floor relative to the structure 10. Such other means includes interengaged bowl and roller elements indicated generally at 16 and 18. The bowl element is shown in the form of a circular pad the flat underside of which is suitably attached to the floor 12 in FIG. 1. The bowl 16 also defines a shallow bowl-shaped surface **16*a* having an upright central axis 17 intersecting the lowerst central point of the surface 16*a*. Surface 16*a* may be spherical or parabolodial at its lowest portion, and its higher portion may be conical to define a shallow angle $\alpha$ relative to the horizontal surface 12**. The angle $\alpha$ is typically between 10° and 35°.

The roller element typically comprises a spherical ball 18 urged into engagment with surface **16*a* in such a way as to exert lateral loading on structure 10 when the ball engages the surface 16*a*** at a location offset from intersection of axis 17 with the lowest point of the bowl surface. Accordingly, such lateral loading tends to displace the structure to restore it to its initial position relative to floor surfce 12, not matter which horizontal direction the floor moves relative to object or structure 10 during an earthquake.

See in this regard FIG. 1*a* showing ball 18 offset from axis 17. In the FIGS. 1 and 2 examples, the ball 18 is carried by object or structure 10 to move laterally therewith whereas the bowl is carried by, i.e. attached to, the floor.

Figure 3:
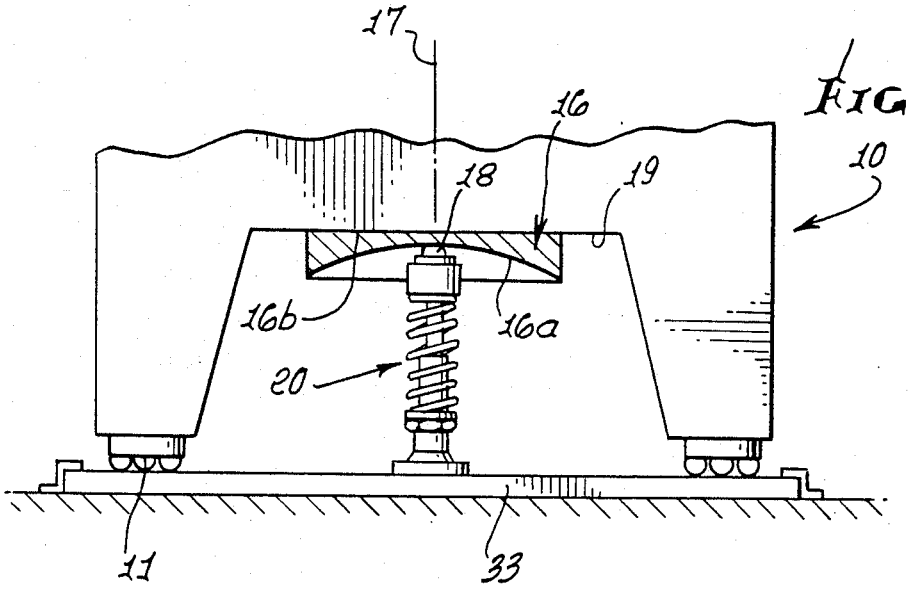
FIG. 3 is a schematic view showing an inverted modification.

Extending the description to FIG. 3, the bowl in this instance is attached at 16*b* to the underside 19 of structure 10 so that surface 16*a* faces downwardly; and the ball 18 is effectively carried by the floor 12. The action, however, insofar as exertion of lateral restoring force is concerned, remains the same. It is to be emphasized, that the structure or object weight is transferred to the floor independently of the ball and bowl in each of FIGS. 1–3, as for example by the rollers 11 previously described. This permits the development of the required laterally directed restoring force as described.

Figure 4:
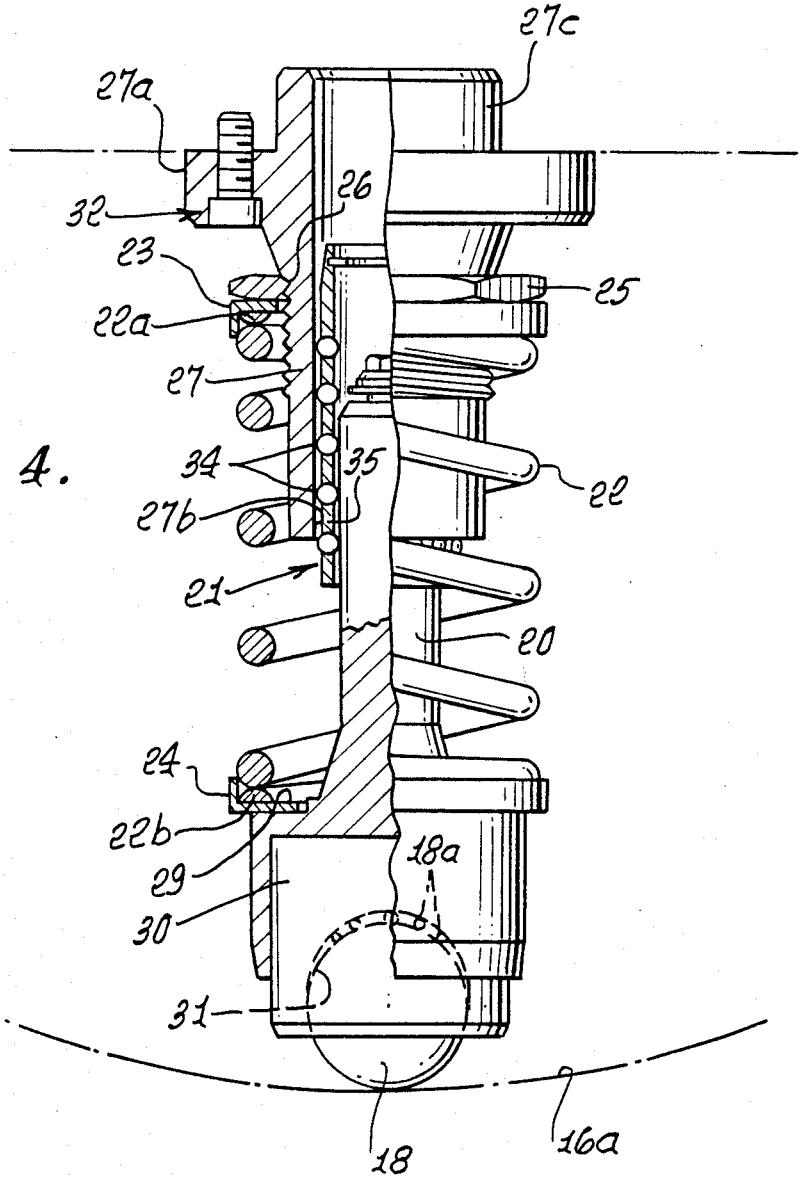
FIG. 4 is an enlarged vertical elevation, cutaway in, half section, to show details of the roller, stem and spring assembly employed in FIGS. 1-3.

Extending the description to FIG. 4, a vertical support stem 20 is provided for the ball 18, and a vertical guide bearing 21 is provided for the stem, there being a compressed coil spring 22 urging the stem and ball toward the center of surface 16*a*. The spring has opposite ends 22*a* and 22*b* engaging vertically spaced annular cups 23 and 24, cup 23 being adjustable up and down as by rotation of a nut 25 thread connected at 26 to a sleeve 27, thereby to vary spring tension. Spring 22 and sleeve 27 extend about the stem received vertically into the sleeve. Cup 24 is seated at 29 on a head 30 defining or carrying a spherical ball race 31 supporting small balls 18*a* in which ball 18 seats. Head 30 is supported by stem 20, as shown. Attachment structure 32 associated with a flange 27*a* on the sleeve serves to attach the sleeve either to the structure 10, as in FIGS. 1 and 2, or to a floor plate 33, as shown in FIG. 3.

Vertical guide bearing 21 includes bearing balls 34 carried by a cage 35, the balls located between the outer surface of the stem, and the bore 27*b* of the sleeve, as shown. The cage may be carried by the stem or by the sleeve.

In FIG. 2, several ball and bowl assemblies are provided at central locations beneath beam members 35. Note openings 37 in those members to receive fasteners for attaching ends 27*c* of the sleeves to those members. Preferably, two or more of such bowl and ball assemblies are employed, for each object or structure 10, to assure orientation, azimuthally.

The balls 11 are preferably located at at least four different positions, i.e., beneath four corner portions of the object or structure 10, to distribute weight transmission uniformly and laterally of the ball and bowl assemblies, to assure desired restoration displacement.

Also in FIG. 2, rubber pads 50 allow some vertical movement.

Figure 5:
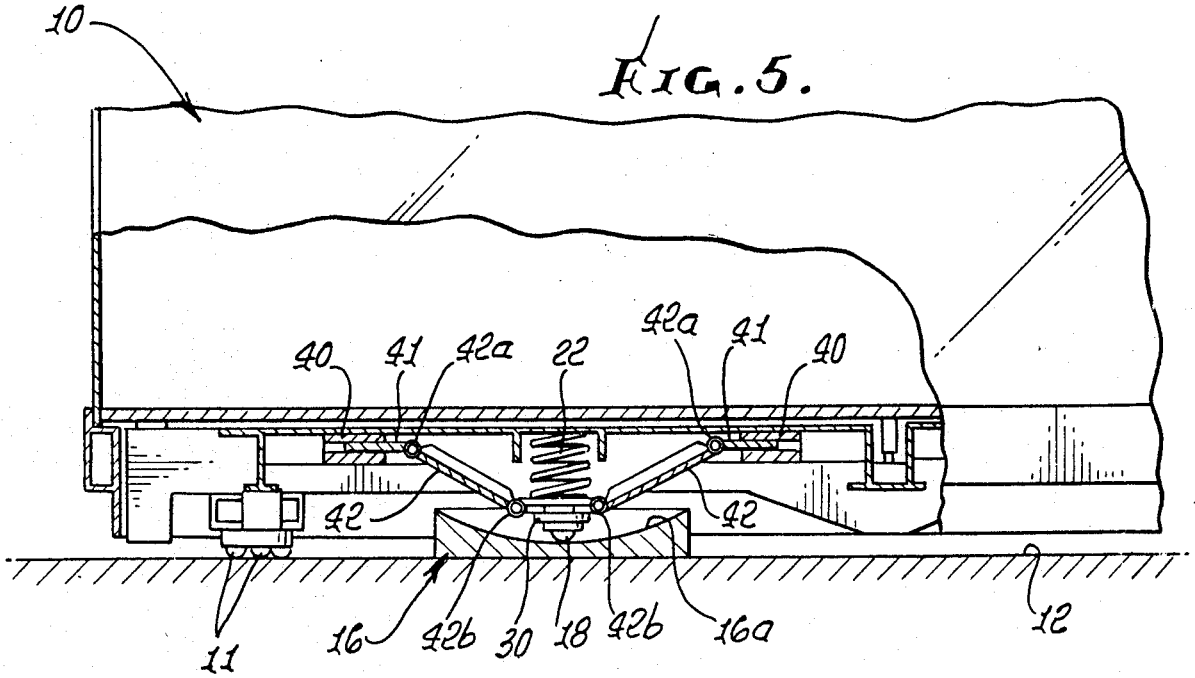
FIG. 5 is a view like FIG. 1, but showing a further modification.

The modification seen in FIG. 5 is similar to the FIG. 1 construction, with the exception of the addition of means acting in conjunction with the ball and bearing assemblies to assist the spring 22 in developing lateral restoring force. Such means is shown to comprise cylinders 40, plungers 41 working in such cylinders, and links 42 pivotally connected at 42*a* to the plunger and at 42*b* to the head 30. Each cylinder may contain compressible fluid acting as yieldably compressible means.

From the foregoing it will be seen that the apparatus consists of two units:

(a) A ROLLER BEARING ASSEMBLY UNIT is attached to the object or the equipment and supports is on the floor. This unit consists of several roller-bearings that allow the object or the equipment to move horizontally on the floor or the supporting surface with minimal effort. The roller bearings can also deflect vertically to accomodate any vertical acceleration which result in an increase in the overall load.

(b) A CENTERING ASSEMBLY UNIT that guides the object or the equipment back to its original location following any horizontal movement. This unit is comprised of two parts: a concave surface created and provided by a bowl and a spring-loaded roller. The spring-loaded roller is an assembly of two-piece telescopic center post with adjustable screws and attachment plate at one end and a roller-bearing housing space at the other end; a spring; and a roller-bearing. The center post is free to move along vertical axis as the spring deflects under vertical load.

The location of the bowl and the spring-loaded roller is interchangeable i.e. either one of the Center Assembly Units parts could be attached to the floor or the equipment or the object to be isolated.

The isolator system functions as follows:

When the object or the equipment is in state of static equilibrium, the roller end of the center post is positioned in the center of the concave surface of the bowl in a neutral state. During an earthquake the floor supporting the isolator mounted object or equipment will vibrate and move back and forth horizontally and to a lesser extent vertically. The horizontal motion will result in the object or the equipment riding on the Roller Bearing assembly thus shifting the position of the Centering Assembly Unit parts in relation to one another. The shift will result in the roller end of the center post becoming engaged and rolling up on the surface of the bowl. This will in turn shorten the center post thus deflecting and loading the spring between the roller and the attachment plate. The loaded spring will push the center post to roll down on the surface of the bowl and to move towards the center of the bowl thus bringing the isolated object or the equipment to its original location where it was prior to the start of the earthquake.

I claim:

1. In apparatus to isolate an object or structure from earthquake motion, and support it on a floor surface the combination comprising:

(a) rollable bearing means supporting one of said object or structure for lateral motion generally parallel to a support, and (b) other means including a bowl element and a roller element which are interengaged to yieldably resist said lateral movement of the structure, said bowl element defining a bowl-shaped surface having an upright axis, and the roller element comprising a ball urged into engagement with said surface to exert lateral load on one of the object and structure when the ball engages the bowl surface in laterally spaced relation to the bowl axis, one of the elements carried by said one of the object and structure to move laterally therewith and the other element carried by the support, (c) said rollable bearing means laterally spaced from said other means including said bowl shaped surface and ball, said rollable bearing means including multiple floor engaging bearings extending at the same level below the level of the bowl-shaped surface.

2. The combination of claim 1 wherein said bowl-shaped surface is carried by the support and faces upwardly.

3. The combination of claim 1 wherein sid bowl-shaped surface is carried by the object or structure and faces downwardly.

4. The combination of claim 1 including also a generally vertically movable stem supporting the ball, and a vertical bearing for the stem, there being a spring urging the stem toward said bowl-shaped surface.

5. The combination of claim 4 wherein the spring is a coil spring extending about the stem, and including an adjuster associated with the stem for adjusting spring tension.

6. The combination of claim 4 including yieldably compressible means including cylinders and plungers carried by one of the object or structure and operatively connected with said stem via linkages to yieldable resist movement of the ball in a spring compressing direction.

7. The combination of claim 1 including a ball race engaging the ball, a stem supporting the ball race, and a linear bearing to accommodate generally vertical movement of said stem.

8. The combination of claim 7 wherein said ball race is spaced between said bowl surface and said linear bearing.

9. The combination of claim 1 wherein said roller bearing means comprises ball bearings laterally offset from said upright axis defined by the bowl-shaped surface.

10. The combination of claim 9 wherein said ball bearings are located at multiple locations to transmit the bulk of object or structure weight to said support surface.

* * * * *